US010744812B2

(12) United States Patent
Hovestadt

(10) Patent No.: US 10,744,812 B2
(45) Date of Patent: Aug. 18, 2020

(54) SECURITY ELEMENT COMPRISING MICROREFLECTORS, AND MANUFACTURING METHOD

(71) Applicant: GIESECKE+DEVRIENT CURRENCY TECHNOLOGY GMBH, Munich (DE)

(72) Inventor: Kathrin Hovestadt, Neuried (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 0 days.

(21) Appl. No.: 16/612,557

(22) PCT Filed: May 8, 2018

(86) PCT No.: PCT/EP2018/000248
§ 371 (c)(1),
(2) Date: Nov. 11, 2019

(87) PCT Pub. No.: WO2018/206147
PCT Pub. Date: Nov. 15, 2018

(65) Prior Publication Data

US 2020/0122499 A1 Apr. 23, 2020

(30) Foreign Application Priority Data

May 12, 2017 (DE) ..... 10 2017 004 585

(51) Int. Cl.
*B42D 25/324* (2014.01)
*B42D 25/328* (2014.01)
(Continued)

(52) U.S. Cl.
CPC ..... *B42D 25/324* (2014.10); *B42D 25/328* (2014.10); *B42D 25/23* (2014.10);
(Continued)

(58) Field of Classification Search
CPC .... B42D 25/324; B42D 25/328; B42D 25/29; B42D 25/373; B42D 25/351; B42D 25/425; B42D 25/23
(Continued)

(56) References Cited

U.S. PATENT DOCUMENTS 9,827,802 B2 11/2017 Fuhse et al.
10,322,601 B2 6/2019 Mengel et al.
(Continued)

FOREIGN PATENT DOCUMENTS

AU 2014356874 B2 6/2016
DE 102010035313 A1 3/2012
(Continued)

OTHER PUBLICATIONS

German Search Report from DE Application No. 102017004585.2, dated Jan. 26, 2018.
(Continued)

*Primary Examiner* — Justin V Lewis
(74) *Attorney, Agent, or Firm* — Workman Nydegger

(57) ABSTRACT

In an areal security element having microreflectors, in particular for manufacturing value documents such as bank notes, cheques or the like, the areal security element has a principal plane and the microreflectors present at least one object which upon tilting and/or rotating the security element has a motion effect which is related to the principal plane. It is provided that the security element has at least a first and a second microreflector pattern which differ from each other both with respect to the object it presents and with
(Continued)

respect to the motion effect produced, wherein the first microreflector pattern is configured such that the motion effect runs at least partly perpendicular to the principal plane, and the second microreflector pattern is configured such that the motion effect runs in the principal plane or parallel thereto.

20 Claims, 3 Drawing Sheets

(51) Int. Cl.

| | |
|---|---|
| ***B42D 25/23*** | (2014.01) |
| ***B42D 25/351*** | (2014.01) |
| ***B42D 25/373*** | (2014.01) |
| ***B42D 25/425*** | (2014.01) |
| *B42D 25/29* | (2014.01) |

(52) U.S. Cl.
CPC ..... *B42D 25/29* (2014.10); *B42D 25/351* (2014.10); *B42D 25/373* (2014.10); *B42D 25/425* (2014.10)

(58) Field of Classification Search
USPC .... 283/67, 70, 72, 74, 94, 98, 109, 110, 901
See application file for complete search history.

(56) References Cited

U.S. PATENT DOCUMENTS

| | | | | |
|---|---|---|---|---|
| 2010/0208036 | A1* | 8/2010 | Kaule ..... | B44F 1/10 348/46 |
| 2013/0093172 | A1 | 4/2013 | Fuhse et al. | |
| 2018/0001690 | A1 | 1/2018 | Fuhse et al. | |
| 2018/0117946 | A1 | 5/2018 | Mengel et al. | |
| 2018/0117947 | A1 | 5/2018 | Fuhse | |

FOREIGN PATENT DOCUMENTS

| | | | |
|---|---|---|---|
| DE | 102013019943 | A1 | 5/2015 |
| DE | 102013019944 | A1 | 5/2015 |
| DE | 102015004027 | A1 | 9/2016 |
| EP | 2600332 | A1 | 6/2013 |
| EP | 2955564 | A1 | 12/2015 |
| WO | 2011066990 | A2 | 6/2011 |
| WO | 2015011494 | A1 | 1/2015 |
| WO | 2015078572 | A1 | 6/2015 |
| WO | 2016180522 | A1 | 11/2016 |

OTHER PUBLICATIONS

International Search Report & Written Opinion from PCT Application No. PCT/EP2018/000248, dated Sep. 26, 2018.

* cited by examiner

SECURITY ELEMENT COMPRISING MICROREFLECTORS, AND MANUFACTURING METHOD

FIELD OF THE INVENTION

The invention relates to a security element having microreflectors, in particular for the manufacturing of value documents, such as bank notes, cheques or the like, the microreflectors being structured such that they present at least one object.

BACKGROUND

In the prior art it is known to present objects by microreflectors in reflection, which objects show motion effects. By way of example, reference is made to WO 2015/078572 A1 and WO 2016/180522 A1. The microreflectors are configured in a microreflector pattern, so that the areal security element is divided into a plurality of pixels which respectively comprise at least one optically effective facet, i.e. at least one microreflector. The areal form of the security element defines a principal plane. The microreflectors are oriented such that upon tilting and/or rotating the security element the object has a motion effect which is related to the principal plane. Instead of a motion effect, the objects can also show a tilt effect. It is known from WO 2011/066990 A2 that an object is presented which appears to be three-dimensional and reaches with its bulge in front of the principal plane or behind the principal plane. Upon tilting the security element, the location of the object in relation to the principal plane remains unchanged.

Security elements having microreflectors showing a motion effect are difficult to reproduce, since the motion effect cannot usually be achieved with conventional printing techniques. At the same time, the motion effect is recognizable to the normal viewer; the microreflectors thus realize a security element that is striking.

SUMMARY

The invention is therefore based on the object of providing a security element having a higher level of forgery resistance; preferably, the recognizable effect should be particularly striking for the viewer.

A security element includes microreflectors and due to its areal configuration establishes a principal plane. The microreflectors present objects which upon tilting and/or rotating the security element have a motion effect which is related to the principal plane. The security element has at least a first and a second microreflector pattern, which differ from each other in their structure of the microreflectors—both in terms of the objects presented and the motion effect produced. The first microreflector pattern is configured such that the motion effect runs at least partly perpendicular to the principal plane. The second microreflector pattern, however, is configured such that the motion effect runs in the principal plane or parallel thereto.

The areal security element is provided for the securing or manufacturing of data carriers, in particular value documents such as bank notes, cheques or the like, or for securing products.

The security element is configured such that different motion effects are combined. For this, the microreflectors are arranged in the two patterns, each pattern effecting a different motion effect for the object presented. The motion effects here differ with respect to the principal plane, which is predetermined by the security element being areal. The first microreflector pattern has a motion effect that runs at least partly perpendicular to the principal plane. Upon tilting and/or rotating the security element, the object for example moves forward or backward in relation to the principal plane. With the rotating/tilting of the security element the object comes closer to the viewer or moves away from him—it changes its location in relation to the principal plane. The second microreflector pattern, however, produces an effect which moves the presented object in the principal plane or parallel thereto. This motion effect differs particularly strikingly from the motion effect which the first microreflector pattern effects on the object presented thereby.

An object moving at least partly perpendicular to the principal plane is also conceivable without a second moving object existing. For the viewer, however, such a motion, for example in front of a static background, is relatively difficult to recognize as a perpendicular motion. The present solution hence not only increases the security, since a motion against the principal plane is even more difficult to reproduce than a motion (lateral or parallel) to the principal plane, but at the same time supports the usability as a security element for the viewer.

The feature "at least partly perpendicular to the principal plane" shall be understood to mean that the motion comprises at least one component which runs perpendicular to the principal plane. The motion does not have to run exclusively along this perpendicular, however. Preferably, the motion direction of the second motion effect is in an angle range between 45 degrees and 135 degrees relative to the principal plane. The motion effects which run in spatially different directions distinguish the two objects very clearly for a viewer. The term "different" is here not limited to a right-angled location of the motion directions.

Particularly preferably, the first microreflector pattern is configured such that the motion effect of the object comprises a motion of the object in an angle range of 45 to 135 degrees (45 to 90 degrees), preferably 60 to 120 degrees, relative to the principal plane and/or a change of an inclination angle and/or azimuth angle of the object relative to the principal plane by more than 45 degrees, preferably more than 90 degrees.

The two objects which are presented by the two microreflector patterns can change their relative location also laterally upon rotating/tilting the security element, when the motion effect which runs partially perpendicular to the principal plane also has a motion component in the lateral direction. In particular it is possible, through the motion effects, to bring the object moving parallel to or in the principal plane into congruence or conformity with the object whose motion effect runs at least partly perpendicular to the principal plane by suitably tilting and/or rotating the security element. This is a particularly striking effect of the security element, which can be checked by a user without further aids.

It is expedient to execute the motion effects linearly along motion directions. However, this is not the only possibility of realization. In particular, the motion effect running in the principal plane or parallel thereto can also be configured with a non-linear motion direction, in particular arcuate or circular, by the second microreflector pattern being configured accordingly. A motion in the principal plane or parallel thereto can also be realized by a rotation or by a pumping, i.e. an enlargement (or reduction) of the area of the object.

In the following or in the description of the figures, the term perpendicular motion/perpendicular motion effect is used partly simplified, as long as the motion is effected "at least partly perpendicular to the principal plane". Analogously, the term lateral or parallel motion (effect) is used partly simplified, if the motion direction is only in the principal plane or parallel thereto.

A motion effect always comprises a motion of the object also between an initial location of the object (before tilting and/or rotating the security element) and an end location of the object. In contrast, the immediate change between two locations of an object is referred to as a tilting effect.

The microreflector patterns contain a plurality of microreflectors. As is known from the prior art, for example WO 2011/066990 A2, these can be configured in the form of pixels. A pixel is a small surface area in which at least one, preferably several microreflectors are located, which have a uniform, a non-uniform or even a quasi-random geometry and represent an image dot of the presented object. Their reflecting properties, for example geometry, alignment and/or coating, are designed such that they produce an image dot of the object presented. Since the micromirrors reflect almost all of the incident light, in contrast to typical printing inks, they appear significantly brighter. Also due to the thus reduced area required, it is possible to realize several different representations on the same area by "interlacing", by using only a certain portion of the available pixels for each representation. Additionally, since the micromirrors work in reflection, it is not necessary to the same extent to dispose them in the same way as a usual printed image next to each other exactly in accordance with the image dots to be represented. The microreflectors rather present an image by reflecting incident illumination radiation and, for a certain viewing distance region, can therefore also be located on a substrate in a spatial arrangement that is not absolutely predetermined by the spatial location of the image dots to be produced of the presented object. Therefore, this description deliberately does not speak of a "representation of an image", but of presentation. This is to express the projection properties which the microreflectors utilize for the image production.

It is therefore possible to arrange the microreflector patterns in a manner interlaced with each other such that microreflectors of the one pattern are adjacent to or surrounded by microreflectors of the other pattern. Checkerboard-like interlacing, line-like interlacing or any microreflector patterns screwed into each other are equally possible in order to present the two objects with the different motion effects.

The differences of the microreflector patterns do not necessarily refer to the pattern structure in which the pixels of the microreflector patterns are arranged in plan view, but to the configuration of the individual pixels and their arrangement which leads to the presentation of the respective object and the motion effect produced. For this reason, it is important for the invention that the microreflector patterns differ from each other with regard to both the object presented and the motion effect produced. This difference does not necessarily require a different geometric division or distribution of the pixels within a microreflector pattern. In this structural division, the microreflector patterns can, as embodiment examples will show, even be completely identical, i.e. can have the same distribution of pixels in plan view. In the pixels, of course, the geometric structures of the microreflectors of the two microreflector patterns are then adapted differently and effect the presentation of different objects as well as different motion effects for the presented objects.

The different motion effects and different objects enable very striking appearances of the security element, which change upon tilting and/or rotating. For example, it is possible to adapt the microreflector patterns in one embodiment such that the object presented by the first microreflector pattern surrounds the object presented by the second microreflector pattern continuously or at least upon a certain rotational position and/or tilt position of the security element. For example, this can produce an effect in which the first object moves three-dimensionally such that the second object moving parallel to the principal plane moves into the first object during rotation or tilting, but in particular also underneath or above the first object. This effect is much more distinct than when merely a parallel shift in the principal plane would be effected, for example a presented object moving parallel would be shifted into a printed image.

In a similar example, it is possible to adapt the microreflector patterns in one embodiment such that with a certain rotation and/or tilting of the security element the object presented by the first microreflector pattern moves underneath and/or above the object presented by the second microreflector pattern. In the course of the motion, the objects can be arranged completely or partially one below the other. Portions of a hidden object (or the hidden object) are (is) respectively not represented (or as long as they lie on top of each other).

With regard to a particularly striking appearance of the security element, at least one of the two microreflector patterns (or a further microreflector pattern) presents a three-dimensionally appearing object. Preferably, this is the first microreflector pattern, since the object thereof also moves in the depth direction, i.e. with respect to the principal plane. Such a motion is particularly striking in the case of a three-dimensionally appearing object. However, in practice it is easier to only adapt the object produced by the second microreflector pattern (or a further object) to be three-dimensionally, for example in the form of a bulged area (within the meaning of WO 2011/066990 A2).

A third microreflector pattern, which produces a three-dimensionally appearing object, remains arranged statically with respect to the principal plane, upon tilting and/or rotating the security element. The third microreflector pattern thus does not produce a motion effect or the object is motionless. On the three-dimensionally appearing object, the third microreflector pattern can present a light reflex travelling on the object according to the tilting and/or rotating.

In one configuration, a data carrier, in particular a value document—for example a bank note, an identity document, a cheque, an electronically readable card, etc. as a value document—is adapted to have a security element of the type mentioned. In other configurations, a product is equipped with the security element for securing it against forgery.

For manufacturing the security element, an areal substrate, which due to this form defines a principal plane, is provided with microreflectors which present at least one object. Upon tilting and/or rotating the security element, the object shows a motion effect which is related to the principal plane. For this purpose, at least the first and second microreflector patterns are configured on the security element. The two microreflector patterns differ from each other with regard to both the object presented by them and the motion effect produced. The first microreflector pattern is configured such that the motion effect of the object it presents runs at least partly perpendicular to the principal plane. The second microreflector pattern is configured such that the motion object of the object it presents runs in the principal plane or parallel thereto.

In the following, the invention is explained in more detail with embodiment examples with reference to the attached drawings which also disclose features essential of the invention. These embodiment examples are for illustrative purposes only and should not be construed as limiting. For example, a description of an embodiment example with a large number of elements or components is not to be interpreted as a requirement that all these elements or components are necessary for implementation. Rather, other embodiment examples may also contain alternative elements and components, fewer elements or components, or additional elements or components. Elements or components of different embodiment examples can be combined with each other unless otherwise specified. Modifications and variations which are described for one of the embodiment examples may also be applicable to other embodiment examples. In order to avoid repetitions, identical elements or elements corresponding to each other are designated with the same reference signs in different figures and are not explained several times.

DETAILED DESCRIPTION OF VARIOUS EMBODIMENTS

Figure 1:
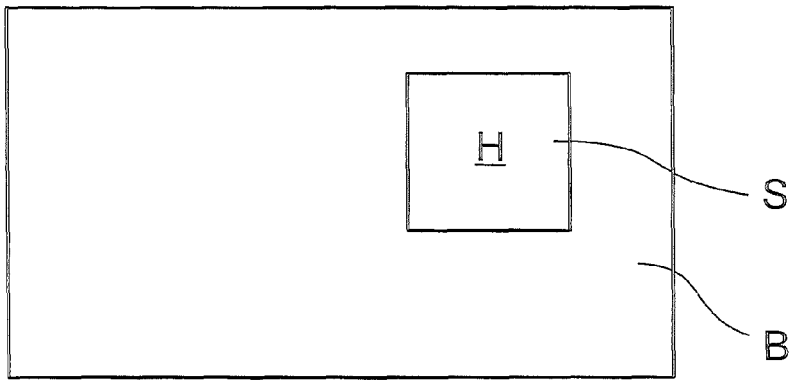
FIG. 1 a plan view onto a bank note having a security element.

FIG. 1 schematically shows a bank note B having a security element S. The bank note B is printed on a banknote paper and the security element S is adapted as a foil element which was applied to the bank note paper. Due to the areal configuration of the security element S and of the bank note B, security element S establishes a principal plane H, which coincides with the drawing plane in FIG. 1.

Figure 2:
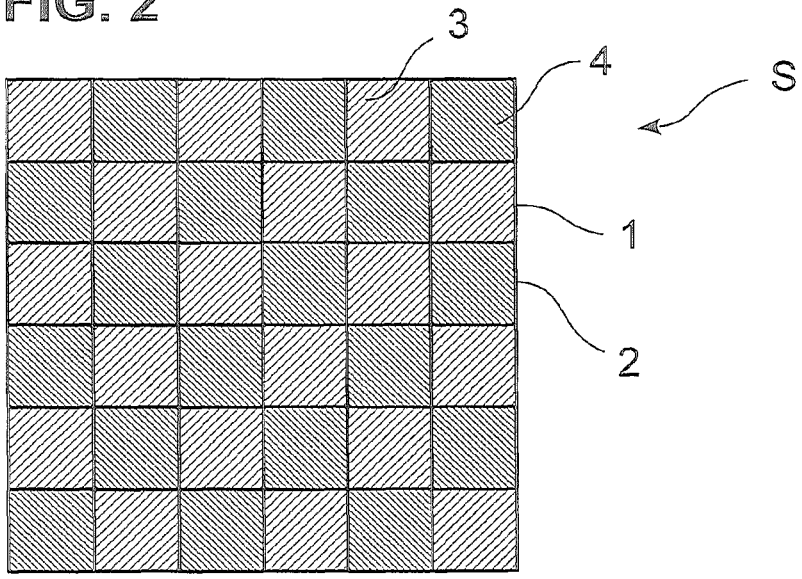
FIG. 2 a schematic representation of the structure of the security element of FIG. 1, FIG. 3 a schematic representation of objects which the security element of FIG. 2 presents to a viewer in plan view and which move differently upon rotating/tilting the security element, FIG. 4 a representation of a further embodiment of the security element, here in the form of a security strip, FIG. 5 a representation of the objects presented by the security strip of FIG. 4, FIG. 6A to 6K different configurations of the presented objects of different embodiments of the security element.

The security element S has a plurality of microreflectors which in plan view present two or more objects P to the viewer. FIG. 2 schematically shows a plan view on the security element S. It has two microreflector patterns 1, 2 which in the embodiment of FIG. 2 are interlaced with each other like a checkerboard pattern, so that horizontal and across microreflector pixels 3 of the first microreflector pattern 1 alternate with microreflector pixels 4 of the second microreflector pattern 2.

Figure 3:
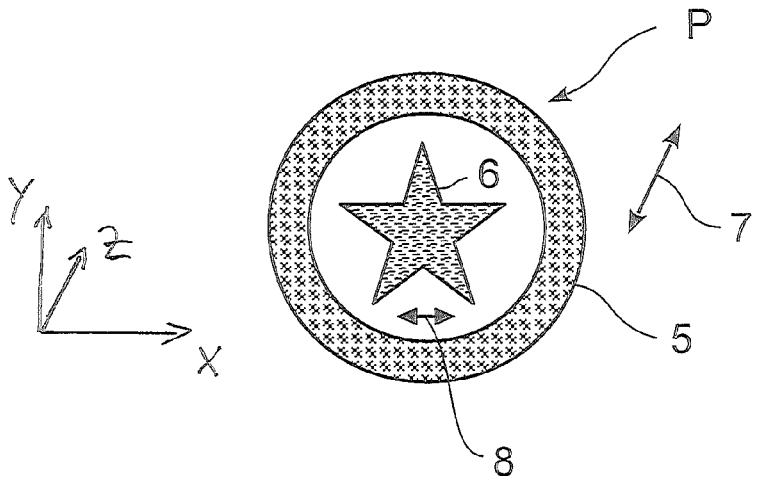

FIG. 3 schematically shows the presented objects P of the security element S. The first microreflector pattern 1 is adapted with respect to its microreflector pixels 3 such that it presents a ring 5 and produces a three-dimensional motion effect 7 upon tilting the principal plane H of the security element S, by the three-dimensional appearing ring 5 moving forward or backward in relation to the principal plane H. This is illustrated by a double arrow 7. In FIG. 3, the principal plane of the security element lies in the X-Y plane; the Z axis is perpendicular to the principal plane.

The microreflector pixels 4 of the second microreflector pattern 2, however, are adapted in such a way that a star 6 is recognizable as the presented object P, which upon rotating and/or tilting the security element S moves within or parallel to the principal plane H. The latter is the case when the microreflector pattern 2 is adapted such that the star 6 floats in front of or behind the principal plane. It does not change its distance from the principal plane during the motion which is produced by the tilting and/or rotating of the security element S, but moves parallel to or within it, as illustrated by the double arrow 8.

The motion effect according to the double arrow 7 can be realized, among others, by the following examples: In a first example, the ring 5 floats above the principal plane H and changes its distance from the principal plane H with the security element being tilted and/or rotated. In this example, the ring 5 does not even have to have a three-dimensional presentation effect. The motion can intersect the principal plane, i.e. the ring 5 can first be located in front of the principal plane and at the end of the continuous motion therebehind. It can also be a two-dimensional element that changes its distance from the principal plane H upon tilting/rotation. In a second example, the ring 5 is presented as a 3D image and changes its appearance to the effect that it appears at different angles to the principal plane H. For example, in a first tilt/rotational position, the ring appears oblique to the principal plane H in such a way that the left half of the ring submerges below the principal plane H, while the right half rises increasingly above the principal plane H. The angular location of the object here is defined by an inclination angle to the principal plane (degree of the inclination) and its, where applicable, static or also moving azimuth angle to the principal plane. Upon tilting or rotating from the first tilt/rotational position to a second tilt/rotational position, the location of the object changes continuously, i.e. with a motion. The left half of the ring moves upward, the right half of the ring moves downward. The motion continues until the ratios are exactly inverted in the second tilt/rotational position. The right half of the ring is now below the principal plane and the left half of the ring is above the principal plane. Upon tilting or rotating, the location of the object is rotated around an axis which lies in the principal plane. The location of the ring 5 has thus changed at least partly perpendicular to the principal plane. At the same time, the lateral location of the star 6 varies for both examples with the tilting/rotating.

Alternatively or additionally, it is possible to adapt the star 6 with a three-dimensional structure. Upon tilting/rotating, this bulge maintains the distance (and its orientation) from the principal plane H; it therefore moves only in the principal plane H or parallel thereto.

Figure 4:
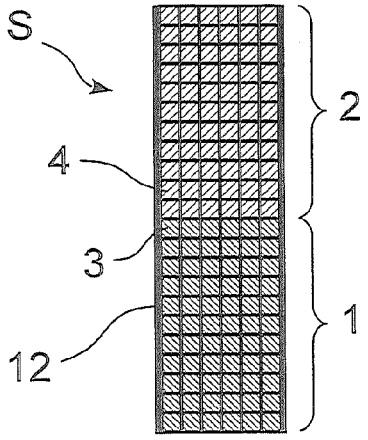
Figure 5:
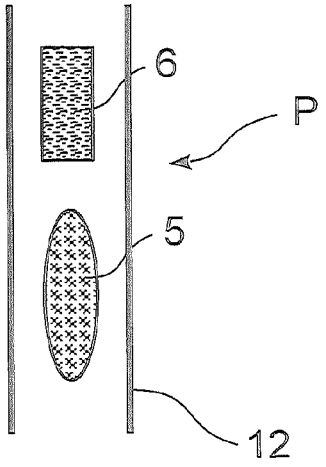

FIG. 4 shows a further embodiment which differs in several aspects from those in FIGS. 2 and 3. On the one hand, the security element S is configured as a security thread of a bank note B. This would also be possible with the embodiment of FIG. 2, 3. On the other hand, the microreflector patterns 1 and 2 here, in terms of plan view, lie next to each other. They are not interlaced with each other. This is also possible with the embodiment of FIG. 2, 3. Thirdly, the presented objects P lie next to each other, as shown in FIG. 5. This too, can be realized as a feature in the embodiment of FIG. 2, 3.

FIGS. 6A to 6K show different embodiments of the presented objects P, the reference signs of corresponding elements in the FIGS. 6A to 6K being provided with a corresponding suffix a to k and otherwise carrying the same numbers in all the embodiments. The number 9 always refers to the object which shows a motion effect having at least one component lying perpendicular to the principal plane H. The number 10 always refers to objects which only move parallel to or in the principal plane. The number 11 designates throughout a property of the corresponding objects which has a bulge. These objects can be regarded as unmoved objects. On such a bulged area of the object the wandering of a light reflex can be simulated, as it would occur according to the bulge and according to the tilting/rotating (in particular as described in WO 2011/066990 A2).

Figure 6A:
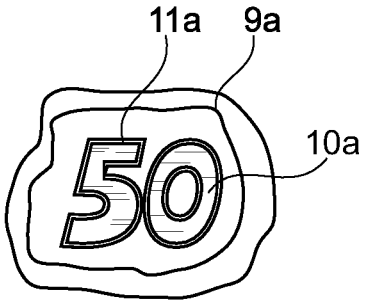

In FIG. 6A there is provided an external 3-dimensional, ring-shaped element 9A surrounding a value numeral 10A which is surrounded by a bulged area 11A. The value numeral 10A comprises objects that are individually perceptible to the viewer, such as stripes which upon tilting the security element, for example around its X-axis, move in the principal plane. In FIG. 3, the stripes in the numeral 10A preferably move against the tilting direction. Upon tilting, the bulge of the area 11A remains unchanged. The ring 9A as a whole continuously changes its distance from the principal plane upon tilting.

Figure 6B:
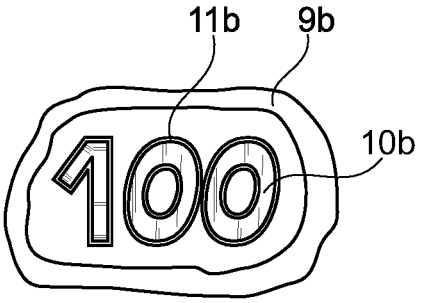

In FIG. 6B, the configuration of the ring differs in the form of an oval and the value numeral with regard to the number represented and with regard to the motion direction of the stripes (along the X-axis). In an alternative, upon tilting, the value numeral could at least partly (or completely) move out of the ring in an arbitrary direction (within the principal plane).

Figure 6C:
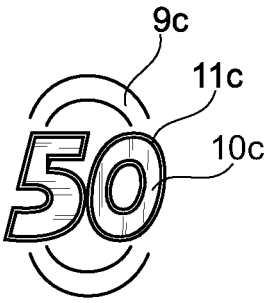

In FIG. 6C, the ring does not completely surround the value numeral, but only in a certain rotational/tilt position, namely when the ring 9C moves into the maximum raised position relative to the principal plane H. In the represented state, the ring 9C is located still below the principal plane or below the plane in which the stripes of the numeral move, and is thus partly not represented (for the viewer it appears to be hidden).

Figure 6D:
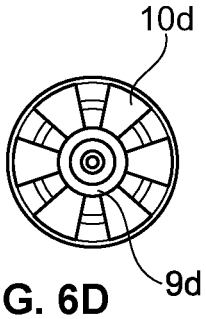

In FIG. 6D the ratios are inverted to the effect that the object 10D surrounds the object 9D. Stripes are represented as (partial) objects which move in a circle. The object 10D rotates around the object 9D upon tilting. For example, the object 9D changes its distance from the principal plane.

Figure 6E:
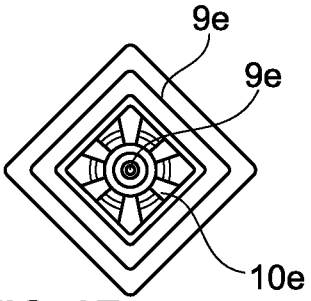
Figure 6F:
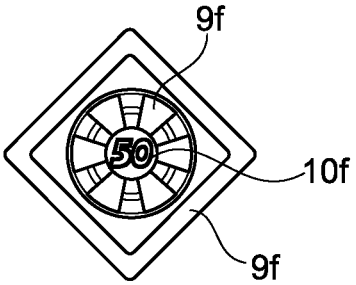
Figure 6G:
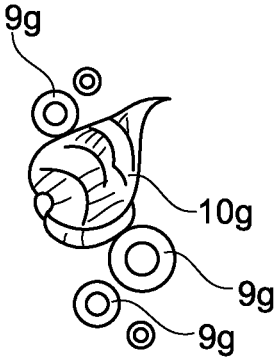
Figure 6H:
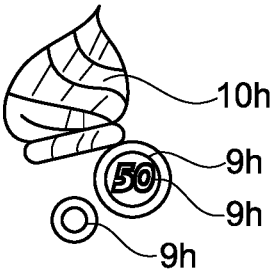
Figure 6I:
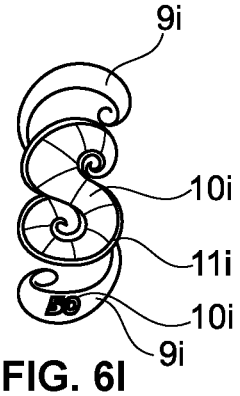

In FIG. 6E an interlacing is provided, according to which a ring-shaped object 10*e* contains both an internal object 9*e* and an externally surrounding object 9*e*. In FIG. 6F an outer and a middle object 9*f* surround an inner object 10*f* which is configured as a value number. FIGS. 6G to 6I show non-linear motions of the stripes, with the non-linear motion following an outer contour of the object. In FIG. 6G several objects 9*g* are located next to an object 10*g*, the objects 9*g* being located above as well as below the object 10*g*. In FIG. 6H the object 9*h* is located completely above the objects 10*h*. In the embodiment of FIG. 6I, above and below an object 10*i* objects 9*i* are arranged, in the lower object 9*i* there being located an object 10*i* which is configured as a value number.

Figure 6J:
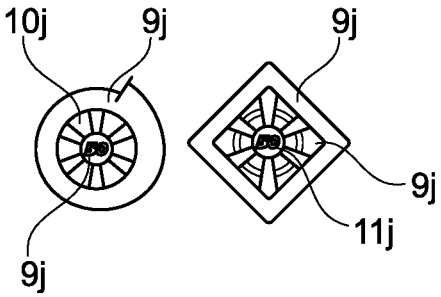
Figure 6K:
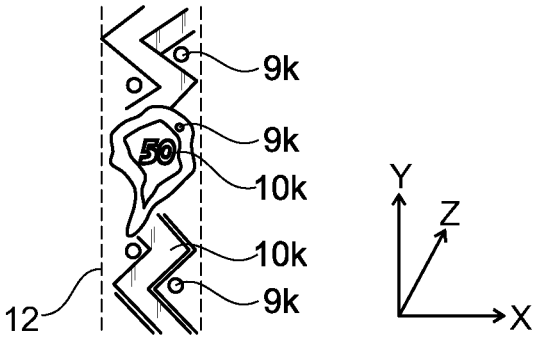

FIG. 6J shows a multi-part configuration corresponding to a combination of FIGS. 6E and 6F. FIG. 6K shows the example of a security strip 12 in which objects 9*k* and 10*k* alternate, some of which also surround each other. The object 9*k* can, for example, be adapted as the outline of a country so as to give a reference to the regional validity of a bank note.

All embodiments of the security element can be realized as foil elements, as foil elements on window recesses or as security threads. They can be applied to paper bank notes or polymer bank notes on both the front side and back side. The same applies to security documents, identity papers etc.

In addition, it is possible to integrate holograms directly or configure them on the same substrate.

The invention claimed is:

1. An areal security element having microreflectors, wherein the areal security element has a principal plane and the microreflectors present at least one object which upon tilting and/or rotating the security element has a motion effect which is related to the principal plane;

wherein the security element has at least a first microreflector pattern and a second microreflector pattern, wherein the first microreflector pattern differs from the second microreflector pattern both in that the first microreflector pattern presents an object different than an object that the second microreflector pattern presents and the first microreflector pattern produces a motion effect that is different than a motion effect produced by the second microreflector pattern; and wherein the first microreflector pattern is configured such that the motion effect of the first microreflector pattern extends at least partly perpendicular to the principal plane, and the second microreflector pattern is configured such that the motion effect of the second microreflector pattern extends in the principal plane or parallel to the principal plane, and wherein the first and second microreflector patterns are arranged at least partly interlaced with each other.

2. The security element according to claim 1, wherein the microreflector patterns are configured such that the objects change their lateral relative location upon rotating and/or tilting the security element.

3. The security element according to claim 1, wherein the second microreflector pattern is configured such that the motion effect runs non-linearly, in a form of an arc, a wave, or a circle.

4. The security element according to claim 1, wherein the microreflector patterns are configured such that upon a predetermined rotation and/or tilting of the security element the object presented by the first microreflector pattern surrounds the object presented by the second microreflector pattern.

5. The security element according to claim 1, wherein at least one of the two microreflector patterns presents an object that appears to be three-dimensional.

6. The security element according to claim 1, wherein the first microreflector pattern is configured such that the motion effect of the object comprises a motion in an angle range of 45 to 135 degrees relative to the principal plane and/or a change of an inclination angle and/or azimuth angle relative to the principal plane by more than 45 degrees.

7. A data carrier, such as a value document, or product having a security element according to claim 1.

8. An areal security element having microreflectors, wherein the areal security element has a principal plane and the microreflectors present at least one object which upon tilting and/or rotating the security element has a motion effect which is related to the principal plane;

wherein the security element has at least a first microreflector pattern and a second microreflector pattern, wherein the first microreflector pattern differs from the second microreflector pattern both in that the first microreflector pattern presents an object different than an object that the second microreflector pattern presents and the first microreflector pattern produces a motion effect that is different than a motion effect produced by the second microreflector pattern; and wherein the first microreflector pattern is configured such that the motion effect of the first microreflector pattern extends at least partly perpendicular to the principal plane, and the second microreflector pattern is configured such that the motion effect of the second microreflector pattern extends in the principal plane or parallel to the principal plane, and wherein a third microreflector pattern produces an object that appears to be three-dimensional which upon tilting and/or rotating remains static relative to the principal plane.

9. The security element according to claim 8, wherein the third microreflector pattern on the that appears to be three-dimensional presents a light reflex movement on the object according to the tilting and/or rotating.

10. An areal security element having microreflectors, wherein the areal security element has a principal plane and the microreflectors present at least one object which upon tilting and/or rotating the security element has a motion effect which is related to the principal plane;

wherein the security element has at least a first microreflector pattern and a second microreflector pattern, wherein the first microreflector pattern differs from the second microreflector pattern both in that the first microreflector pattern presents an object different than an object that the second microreflector pattern presents and the first microreflector pattern produces a motion effect that is different than a motion effect produced by the second microreflector pattern; and wherein the first microreflector pattern is configured such that the motion effect of the first microreflector pattern extends at least partly perpendicular to the principal plane, and the second microreflector pattern is configured such that the motion effect of the second microreflector pattern extends in the principal plane or parallel to the principal plane, and wherein the first and second microreflector patterns are arranged at least partly adjacent to each other.

11. A manufacturing method for an areal security element, providing an areal substrate having a principal plane and microreflectors which present at least one object which upon tilting and/or rotating the security element has a motion effect which is related to the principal plane;

wherein the security element has at least a first microreflector pattern and a second microreflector pattern, wherein the first microreflector pattern differs from the second microreflector pattern both in that the first microreflector pattern presents an object different than an object that the second microreflector pattern presents and the first microreflector pattern produces a motion effect that is different than a motion effect produced by the second microreflector pattern; and wherein the first microreflector pattern is configured such that the motion effect of the first microreflector pattern extends at least partly perpendicular to the principal plane, and the second microreflector pattern is configured such that the motion effect of the second microreflector pattern extends in the principal plane or parallel to the principal plane, and wherein the first and second microreflector patterns are arranged at least partly interlaced with each other.

12. The manufacturing method according to claim 11, wherein the microreflector patterns are configured such that the objects change their lateral relative location upon rotating and/or tilting the security element.

13. The manufacturing method according to claim 11, wherein the second microreflector pattern is configured such that the motion effect runs non-linearly, in a form of an arc, a wave, or a circle.

14. The manufacturing method according to claim 11, wherein the microreflector patterns are configured such that upon a predetermined rotation and/or tilting of the security element the object presented by the first microreflector pattern surrounds the object presented by the second microreflector pattern.

15. The manufacturing method according to claim 11, wherein at least one of the two microreflector patterns presents an object that appears to be three-dimensional.

16. The manufacturing method according to claim 11, wherein a third microreflector pattern produces an object that appears to be three-dimensional which upon tilting and/or rotating remains static relative to the principal plane.

17. The manufacturing method according to claim 16, wherein the third microreflector pattern on the that appears to be three-dimensional presents a light reflex movement on the object according to the tilting and/or rotating.

18. The manufacturing method according to claim 11, wherein the first and second microreflector patterns are arranged at least partly adjacent to each other.

19. The manufacturing method according to claim 11, wherein the first microreflector pattern is configured such that the motion effect of the object comprises a motion in an angle range of 45 to 135 degrees relative to the principal plane.

20. The manufacturing method according to claim 11, wherein the first microreflector pattern is configured such that the motion effect of the object comprises a change of an inclination angle and/or azimuth angle relative to the principal plane by more than 45 degrees.

* * * * *